US007419397B2

(12) United States Patent
Casperson et al.

(10) Patent No.: US 7,419,397 B2
(45) Date of Patent: Sep. 2, 2008

(54) HIGH VOLTAGE CONNECTOR ASSEMBLY

(75) Inventors: Paul G. Casperson, Peoria, IL (US); Ronald P. Dettman, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/598,351

(22) Filed: Nov. 13, 2006

(65) Prior Publication Data

US 2008/0113552 A1 May 15, 2008

(51) Int. Cl.
*H01R 13/52* (2006.01)

(52) U.S. Cl. ..... 439/281

(58) Field of Classification Search ..... 439/108, 439/281, 272–274, 279, 49, 76, 78, 283, 439/595, 598, 752
See application file for complete search history.

(56) References Cited

U.S. PATENT DOCUMENTS

| | | | | |
|---|---|---|---|---|
| 2,217,219 | A * | 10/1940 | Field | 439/345 |
| 3,783,434 | A | 1/1974 | Ransford, III | |
| 3,794,958 | A | 2/1974 | Glover | |
| 3,824,526 | A | 7/1974 | Glover | |
| 3,842,390 | A | 10/1974 | Glover et al. | |
| 3,871,735 | A | 3/1975 | Hermann, Jr. | |
| 3,892,462 | A | 7/1975 | Glover et al. | |
| 3,963,295 | A | 6/1976 | Askman et al. | |
| 3,977,750 | A | 8/1976 | Glover et al. | |
| 4,026,015 | A | 5/1977 | Askman et al. | |
| 4,834,678 | A | 5/1989 | Emadi et al. | |
| 4,986,764 | A | 1/1991 | Eaby et al. | |
| 4,990,723 | A | 2/1991 | Ziberna et al. | |
| 4,993,803 | A * | 2/1991 | Suverison et al. | 385/88 |
| 5,100,346 | A * | 3/1992 | McCardell | 439/595 |
| 5,213,520 | A | 5/1993 | Casey et al. | |
| 5,231,357 | A | 7/1993 | Moody et al. | |
| 5,580,266 | A | 12/1996 | Shelly | |
| 5,591,049 | A | 1/1997 | Dohnishi | |
| 5,593,320 | A | 1/1997 | Konda et al. | |
| 5,626,486 | A * | 5/1997 | Shelly et al. | 439/281 |
| 5,797,761 | A | 8/1998 | Ring | |
| 5,876,229 | A | 3/1999 | Negle | |
| 6,213,805 | B1 | 4/2001 | Jedlitschka et al. | |
| 6,361,349 | B1 | 3/2002 | Hung | |
| 6,454,602 | B1 | 9/2002 | Sharrow | |
| 2002/0132513 | A1 | 9/2002 | Sharrow | |
| 2002/0132522 | A1 | 9/2002 | Miyazaki et al. | |
| 2005/0032404 | A1 | 2/2005 | Furuta et al. | |

FOREIGN PATENT DOCUMENTS

| | | |
|---|---|---|
| DE | 295 13 684 | 10/1995 |
| FR | 2861507 | 4/2005 |

* cited by examiner

*Primary Examiner*—Edwin A. León
(74) *Attorney, Agent, or Firm*—Kevin C. Earle

(57) ABSTRACT

An electrical connector for a high voltage application. The connector may include a plug housing having a plurality of plug openings and a header housing have a plurality of header openings. The plurality of header openings may be matable with a respective plug opening. A plurality of sockets are insertable into each respective plug opening. A plurality of pins may be operable to be received by a corresponding socket. The plug housing and sockets may be configured to maintain a seal with the plug housing connected to and disconnected from the header housing.

15 Claims, 5 Drawing Sheets

HIGH VOLTAGE CONNECTOR ASSEMBLY

TECHNICAL FIELD

The present invention relates generally to connectors and more particularly to high voltage connector assemblies.

BACKGROUND

Connectors are well known in the art for establishing electrical connection between electronic devices. Nearly every electrical system has one or more electrical connectors that enable the establishment of electrical connections between various portions of the system. Electrical connectors are also frequently used to provide electrical connection in high voltage, high current energy systems. Such connectors must operate with high reliability, and are often under severe environmental conditions. Some of the primary concerns associated with high voltage applications are the discharge of voltage along a path from the connection to the environment and voltage leakage at the connection.

In U.S. Pat. No. 6,945,817, a connecting structure is disclosed for similar applications. However, the lug and gland connection disclosed may provide less than adequate contact area and poor sealing characteristics when unmated. When this connector is unmated, moisture can access the braided wire of the cable. This can lead to corrosion of the cable and possible capillary action.

It is desirable to provide an electrical connector for high voltage applications that maximizes the surface contact area, minimizes the amount of voltage discharge, simplifies the process involved in making the connector and establishing a connection, and maintains a sealed condition while mated as well as un-mated.

SUMMARY OF THE INVENTION

It is to be understood that both the foregoing general description and the following detailed description are exemplary and explanatory only and are not restrictive of the invention as claimed.

One aspect of the present invention is directed to a connector having a plug housing and a header housing. The plug housing has a plurality of plug openings. A plurality if sockets are insertable in a respective plug opening. The header housing has a plurality of header openings. Each header opening is matable with a respective plug opening. A plurality of pins are operable to be received by a corresponding socket. The plug housing and sockets are configured to maintain a seal with the plug housing connected to and disconnected from the header housing. Another aspect of the present invention is directed to a connector as mentioned with each pin molded in a respective header opening

BRIEF DESCRIPTION OF THE DRAWINGS

The accompanying drawings, which are incorporated in and constitute a part of this specification, illustrate several exemplary embodiments of the invention and, together with the description, serve to explain the principles of the invention. In the drawings.

DETAILED DESCRIPTION

Reference will now be made in detail to embodiments of the invention, examples of which are illustrated in the accompanying drawings. Whenever possible, the same reference numbers will be used throughout the drawings to refer to the same or like parts.

Figure 1:
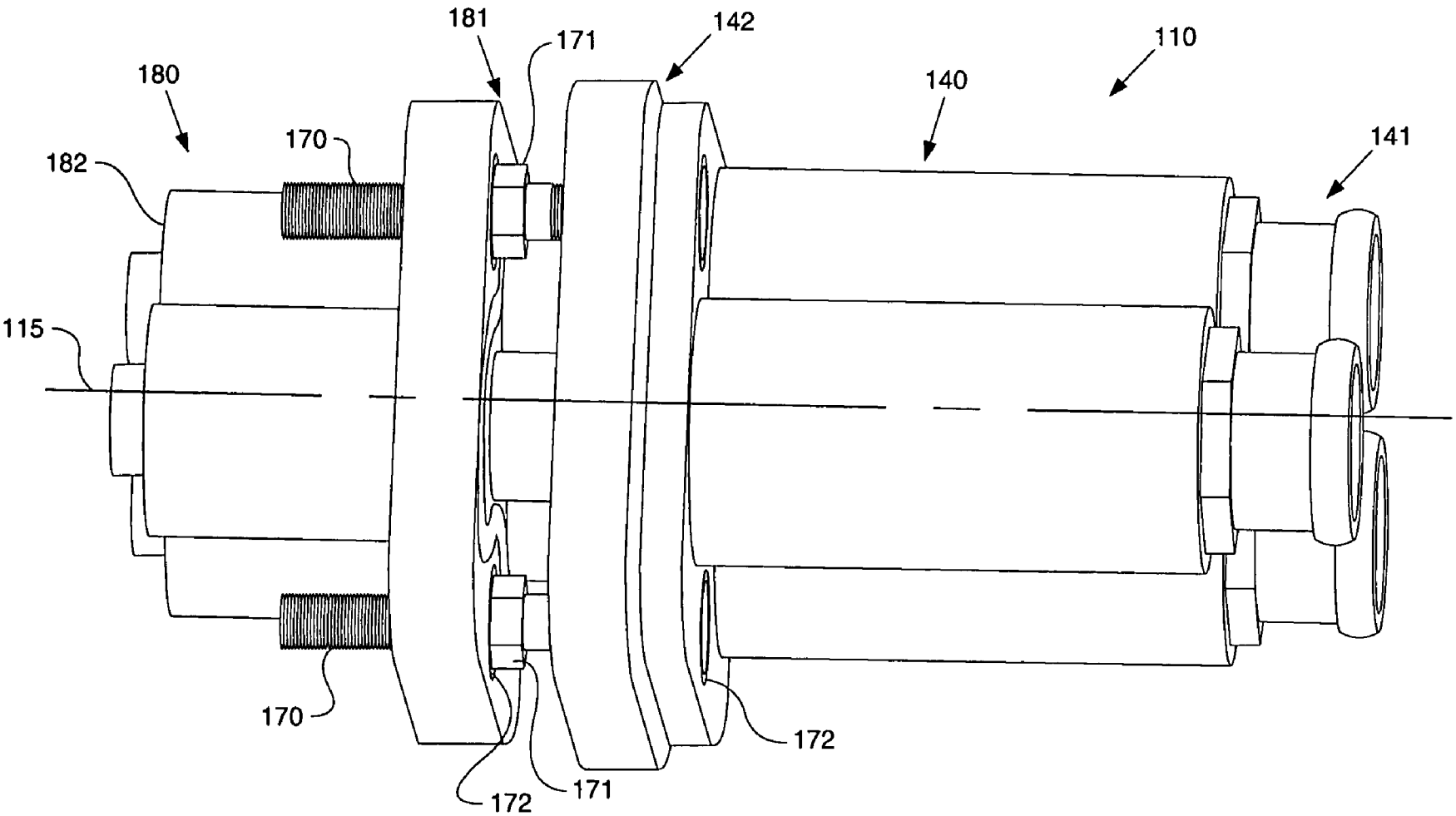
FIG. 1 is a side perspective view of a partially engaged connector according to one embodiment of the present disclosure.

Referring to FIG. 1, there is shown a perspective view of a connector 110 according to one embodiment of the present disclosure. This connector 110 is shown partially engaged. The connector 110 may include a plug 140 and a header 180. The connector 110 may be configured to extend along a longitudinal axis 115. The plug 140 and header 180 may also be configured to extend along this same longitudinal axis 115.

The header 180 may have a first end 181 to be attached to a plug second end 142 and second end 182 to be attached to a an electrical system (not shown) which may be beyond a bulkhead (not shown). The plug first end 141 may be attached to three cables (not shown). Although the plug first end 141 is shown having connection points for three cables (not shown), the configuration and number of cables may vary depending on the type of application. The total number of cables may be more or less than three cables.

Furthermore, the connector 110 is shown as being in a triangular configuration for the three cables (not shown). However, the connector 110 may also be arranged in a number of configurations, such as, but not limited to, a straight configuration, a box configuration, and the like. The configuration of the connector 110 may also be dependent on the number of cables.

The connector 110 may also be secured such that the plug 140 and the header 180 provide a seal while they are mated. FIG. 1 depicts the plug 140 and header 180 being attached utilizing a plurality of threaded stainless steel studs 170 and stainless steel nuts 171 routed through stainless steel inserts 172 in both the plug housing 143 and header housing 183. The inserts 172 in the plug and header housings 143,183 may allow for metal-to-metal contact with the stud 170 and nuts 171 and may allow for increased torque through the connector 110. The nuts 171 may be integral to the design of the stud 170 and provide for an integral hex feature to the stud 170. The stud 170 may also utilize differing threaded diameters on either side of the integral hex feature, or nut 171. It may be preferential to have the larger diameter section on the header side of the connector 110 that would engage the electrical system (not shown). The nut 171 may also be designed to engage the insert and limit movement of the nut 171 against the insert 172. An additional nut (not shown) may be used to help maintain a firm connection between the plug 140 and the header 180. However, the plug 140 and header 180 may be attached in any one of a number of ways, including, but not limited to, adhesive, screws, bolts, mating clips, and the like. Securing the plug 140 and header 180 together by one of the above methods preferably helps to maintain adequate connection and sealing in harsh environments. Although the threaded studs 170, nuts 171 and inserts 172 are described as being made from stainless steel, they may be made from any one of a number of suitable materials for the application and may be made from similar or dissimilar materials.

Figure 2:
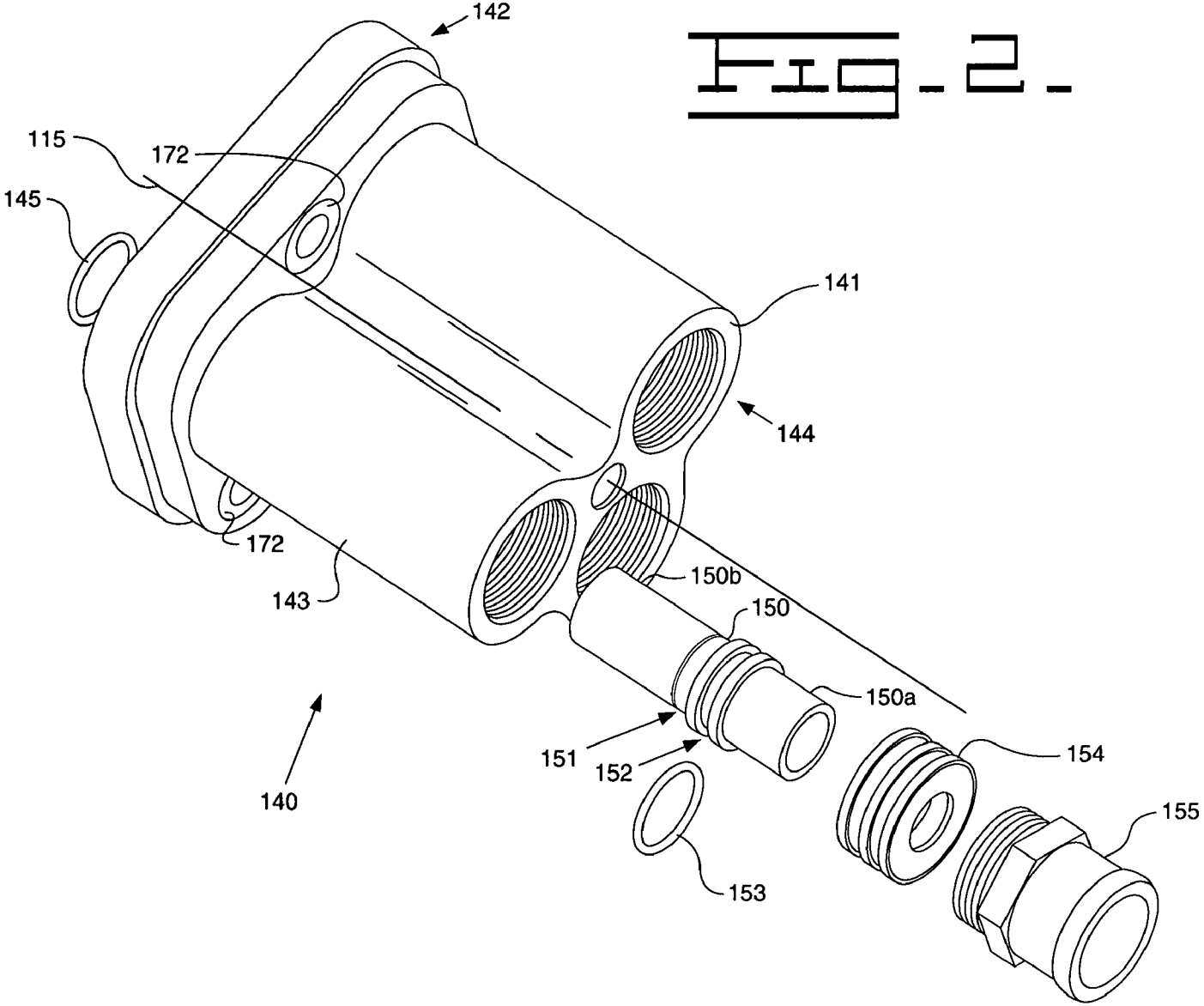
FIG. 2 is a partial exploded perspective view of the connector in FIG. 1 with the header removed.

FIG. 2 is a partial exploded perspective view of the connector 110 in FIG. 1 with the header 180 removed. The plug 140 may have a main plug housing 143 with a first end 141 and a second end 142. The plug housing 143 may be molded in any suitable shape and from any one of a number of materials suitable for the application, including plastic, elastomers, and the like. The plug housing 143 may also be configured to have a predetermined number of plug openings 144 as required by the application.

Each plug opening 144 may be configured to receive a socket 150, or a female component, that may be held in place within the plug opening 144. The socket 150 may have a first end 150*a*, a second end 150*b* and a retaining clip groove 151 therebetween to receive a retaining clip 145 into the retaining clip groove 151. Although the socket 150 is shown to be help in place with a socket retaining clip 145, this also may be accomplished in any number of ways suitable in the art. A seal channel 152 may also be provided about the socket 150 to receive a socket seal 153 and engage an inner surface of the plug opening 144.

The socket 150 may be made of any one of a number of materials capable of conducting electrical currents, such as copper, copper alloys, and the like. Alternatively, the socket 150 may be made from a copper or a material other than copper and have a plating material applied using any one of a number of suitable materials, including copper, silver, gold, various alloys, and the like. The socket first end 150*a* may be attached to the cable (not shown) in one of a number of ways to achieve a suitable connection, such as by soldering, crimping, and the like. A cable seal 154 may also be configured about the socket first end 150*a* and the cable (not shown) and a cable strain relief 155 may be attached to the plug opening 144 through which the cable (not shown) may extend.

Figure 3B:
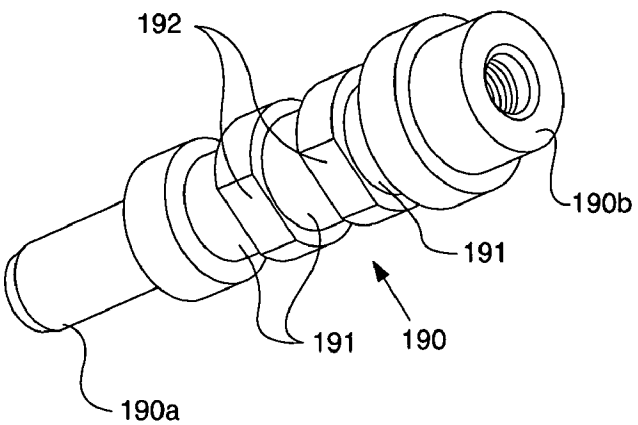
FIG. 3*b* is a perspective view of the header connector pin in FIG. 3.
Figure 3A:
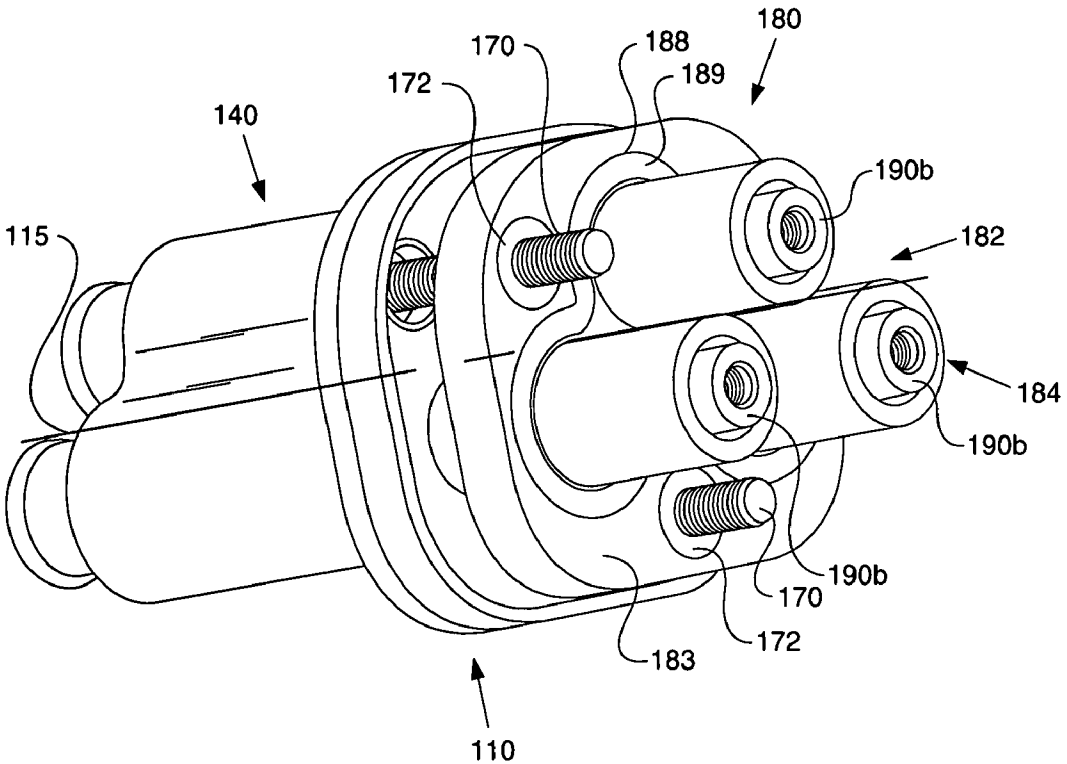
FIG. 3*a* is a perspective view of the header second end of the connector in FIG. 1.

FIG. 3*a* is a perspective view of the header second end 182 of the connector 110 in FIG. 1. As mentioned above, the header second end 182 may be attached to an electrical system (not shown) and the first end 181 may be attached to the plug second end 142. The header 180 may have a header housing 183 that may be molded using similar configurations and materials as mentioned for the plug housing 143. The header housing 183 may also be configured to have a similar number of header openings 184 that correspond and may be matable to the plug openings 144. Each header opening 184 may contain therein a pin with the pin second end 190*b* shown extending through the header opening 184. A pin seal (not shown) may also be configured about each pin 190 between the exterior surface of the pin second end 190*b* and the interior surface of the header opening 184. The header and plug openings 184,144 may be isolated from one another and may isolate each socket 150 to pin 190 interaction.

FIG. 3*b* is a perspective view of the pin 190 removed from the connector 110 in FIG. 3*a*. The pin 190, or male component, may have a first end 190*a* and a second end 190*b*. The pin second end 190*b* may attach to an electrical contact of a bulkhead of an electrical system (not shown). The pin first end 190*a* may engage the socket second end 150*b*. Connection between the socket 150 and pin 190 may be adjusted through the use of various surface finishes to the socket 150 and the pin 190. This may also be accomplished through the use of sleeves (not shown) within the socket 150 to aid in engaging the pin 190.

The pin 190 may be molded within the header housing 183 to extend through at least a portion of the header opening 184. The pin 190 may have pin grooves 191 to engage an inner surface of the header opening 184 and restrict vertical movement of the pin 190 along the longitudinal axis 115. The pin may also have machined flats 192 to engage the inner surface of the header openings 184 to restrict rotation of the pin 190. Alternatively, the pin 190 may be designed into the header housing 183 such that it may be installed after the header housing 183 is molded and may be removable. The pin 190 may also be made from any one of a number of materials or plated with materials capable of conducting electrical currents as mentioned above with regard to the socket 150. Although the header 180 is shown having a pin 190 and the plug 140 is shown having a socket 150, it is also contemplated that the pin 190 and socket 150 could be alternated within the plug 140 and header 180.

Figure 4:
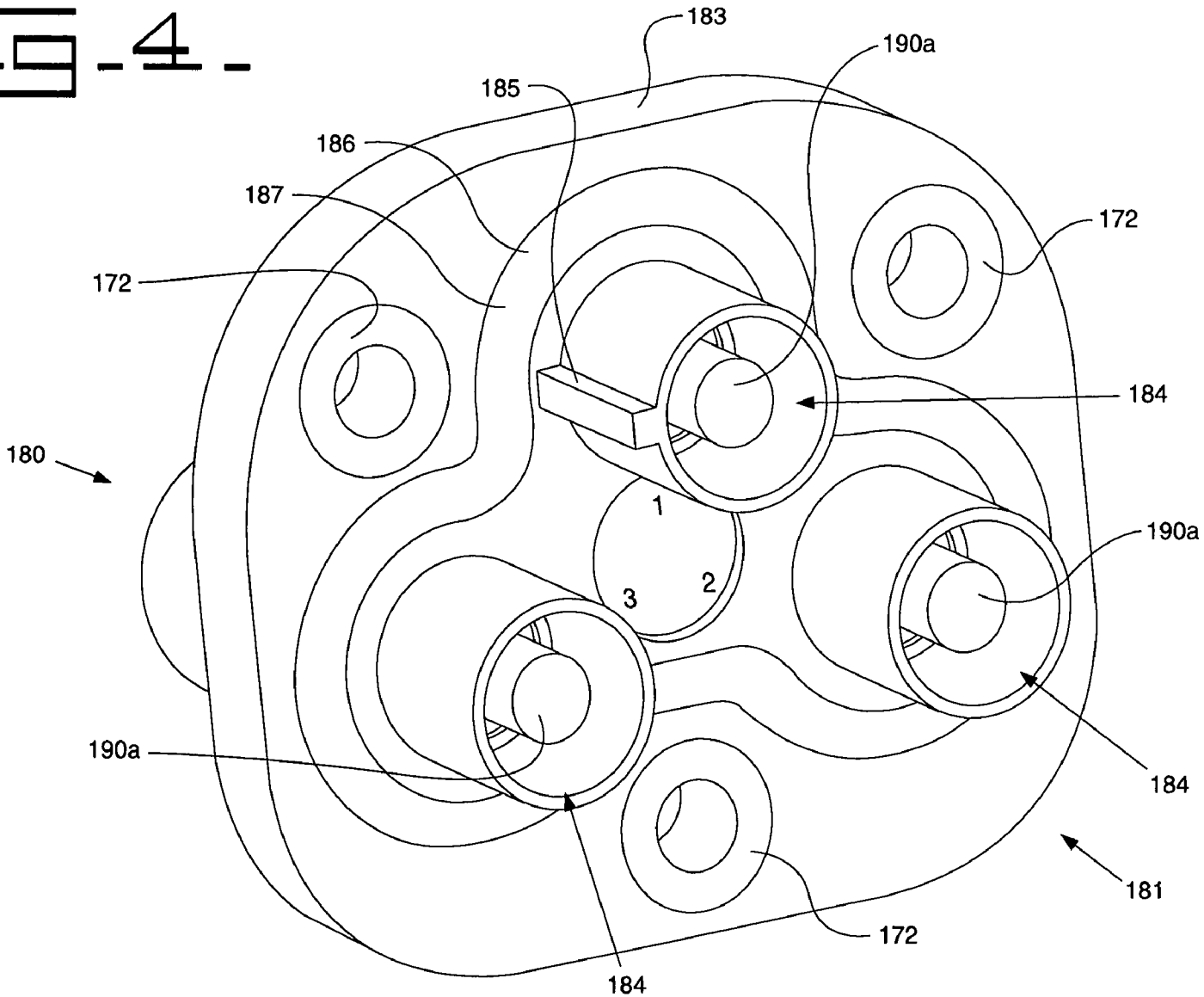
FIG. 4 is a perspective view of the header first end of the connector of FIG. 1 with the plug removed.

FIG. 4 is a perspective view of the header first end 181 of the connector 110 of FIG. 1 with the plug 140 removed. The header first end 181 shows a pin first end 190*a* extending from each of the header openings 184. The exterior wall of one of the header openings 184 is shown to have an opening alignment guide 185 that may correspond to a mating opening alignment guide (not shown) on the interior wall of the plug opening 144. Alternatively, the opening alignment guide 185 may be configured on none or a portion of the header openings 184 and corresponding plug openings 144. The opening alignment guide 185 may be configured in a number of ways as found in the art on the plug and the header openings 144, 184, or may be separate from the plug and header openings 144, 184 altogether. The header first end 181 may also have a header housing groove 186 that may contain a header housing seal 187. This header housing seal 186 and groove 187 may be configured about the perimeter of the header openings 184 to seal against the plug second end 142. Although a groove and seal is not shown in the plug second end 142, a groove and seal may be additionally or alternatively configured into the plug second end 142 to seal against the header first end 181. A similar header housing groove 188 and seal 189, as shown in FIG. 3*a*, may also be configured on the header second end 182 about the perimeter of the header openings 184 to seal against the electrical system bulkhead (not shown).

Figure 5:
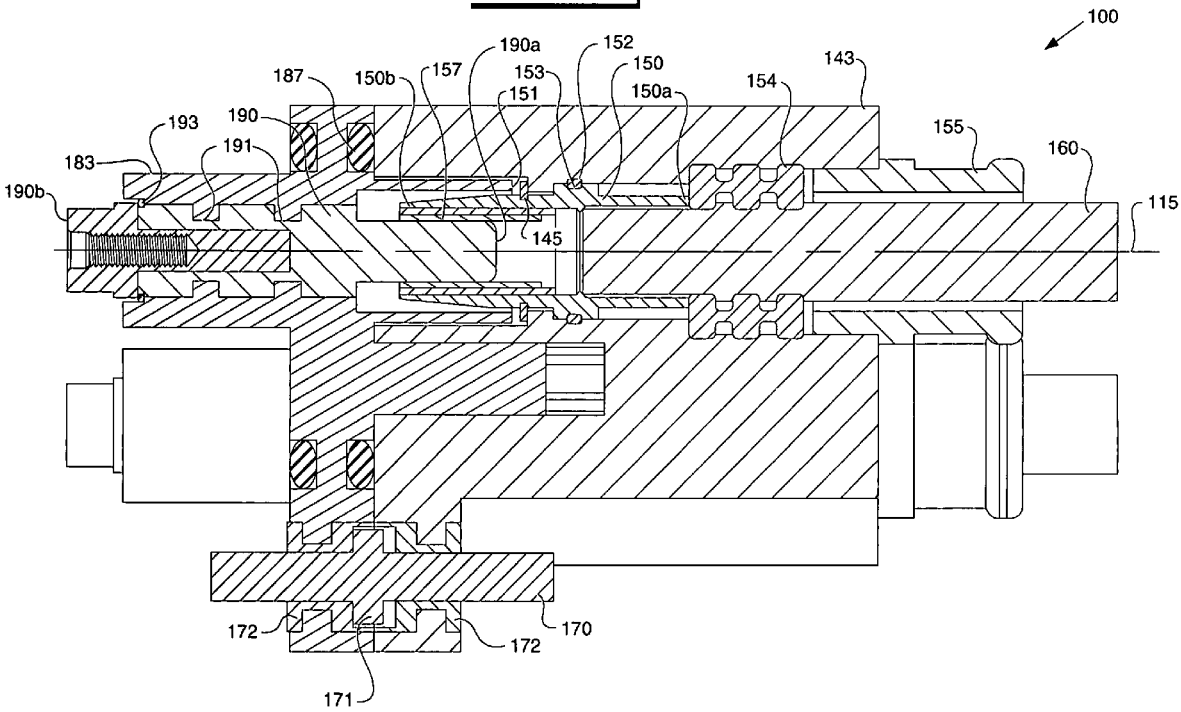
FIG. 5 is a cross section diagram of the connector of FIG. 1.

FIG. 5 is a cross section diagram of the connector 110 of FIG. 1. The socket 150 of the plug 140 is shown having a sleeve 157. The sleeve 157 is engaged with the pin 190 of the header 180 at the pin first end 190*a*. The socket 150 is also shown connected to the cable 160 with the cable seal 154 about the socket first end 150*a* and a portion of the cable. Although it is not shown here, the pin second end 190*b* may be connected to an electrical system (not shown). An additional pin seal 193 may be used about the pin second end 190*b* to seal between the pin second end 190*b* and the header housing 183. Although a pin seal 193 is shown, the seal may also be created using substances such as epoxy, sealant, and the like.

INDUSTRIAL APPLICABILITY

Embodiments of the present application are applicable to provide electrical connection in high voltage, high current energy systems where it is important for the connector 110 to be sealed while it is mated as well as when it is unmated. Utilizing the cable seal 154 about the connection point between the cable 160 and the socket first end 150*a* as well as the seal 153 located in the seal channel 152 of the socket 150 may aid with maintaining a watertight seal in the plug 140 when the plug 140 and the header 180 are connected in addition to when they are disconnected. This may prevent any moisture from affecting the portion of the socket first end 150*a* that may be crimped about the cable 160 which could lead to corrosion of the cable 160 and possible capillary action. The header housing seals 187,189 and the pin seal 193 may aid in maintaining a watertight seal throughout the header 180 when the header 180 is connected and disconnected to the electrical system (not shown) and when the plug 140 is connected and disconnected to the header 180. Furthermore, utilizing the pin and socket configuration between the plug 140 and the header 180 may enable a simplified and stable connection with improved contact area for conveying current between the connector halves.

It may be preferable that once the header 180 is connected to the electrical system (not shown) that the header stay connected to the electrical system and sealed to the electrical system even in case of failure of the connector 110 such that the electrical system is protected from moisture. Incorporation of studs 170 with differing thread sizes on either side of the integral nut 171 may aid in preventing a moisture path in case of a failure of the connector 110. Installing the stud 170 with the larger diameter on the side of the header 180 and the smaller diameter on the side of the plug 140 may ensure that any failures of the stud 170 occur on the side of the plug 140 thereby maintaining a higher level of protection to the electrical system.

It will be apparent to those skilled in the art that various modifications and variations can be made in the system and method of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A connector, comprising:

a plug housing having a plurality of plug openings;

a plurality of sockets, each inserted in a respective plug opening when the connector is assembled;

a header housing having a plurality of header openings, each header opening being mated with a respective plug opening when the header housing is connected to the plug housing;

a plurality of pins, each pin received by a corresponding socket when the connector is assembled, the header housing and pins maintaining a seal when the header housing is connected to and disconnected from an electrical system;

a socket seal arranged about a seal channel on the plurality of sockets;

a plurality of cables connected to a first end of the plurality of sockets when the connector is assembled;

a cable seal arranged about at least a portion of each of the plurality of cables and adjacent to each socket; and the plug housing and sockets maintaining a sealing relationship when the plug housing is connected to and disconnected from the header housing.

2. The connector of claim 1, further comprising:

the header housing and pins maintaining a seal when the header housing is connected to and disconnected from the plug housing.

3. The connector of claim 1, further comprising:

a pin seal arranged about each of the plurality of pins.

4. The connector of claim 1, wherein each of the plurality of pin openings is isolated from the other pin openings; and wherein each of the plurality of header openings is isolated from the other header openings.

5. The connector of claim 1, further comprising:

at least one seal located about at least one of the plurality of pin and socket openings on a mating face between the plug and header housings.

6. The connector of claim 1, wherein at least one of the plug and header housings have an alignment guide.

7. The connector of claim 1, wherein rotation and vertical movement of the pin in relation to the header housing is restricted when the pin is within the header housing.

8. The connector of claim 1, wherein each pin is connected to the electrical system when the connector is assembled, the header housing and pins maintaining a seal with the header housing connected to and disconnected from the electrical system.

9. The connector of claim 1, wherein the plurality of pins are molded into the associated header opening.

10. The connector of claim 1, wherein at least one of the plug and header housings are molded.

11. The connector of claim 10, wherein at least one of the plurality of sockets and pins are molded into the associated plug and header housing.

12. The connector of claim 11, wherein at least one of the sockets and pins are machined to restrict rotation and vertical movement in relation to the associated plug and header housing.

13. The connector of claim 1, further comprising:

at least one threaded stud extending through the plug and header housings, the at least one threaded stud having an integral nut with a first threaded portion extending from one side of the integral nut and a second threaded portion extending from an opposite side of the integral nut, the first threaded portion extending through the plug housing and the second threaded portion extending through the header housing.

14. The connector of claim 13, wherein the first threaded portion has a diameter greater than the second threaded portion.

15. A connector, comprising:

a plug housing having a plurality of plug openings, each plug opening being isolated from the other plug openings;

a plurality of sockets, each inserted in a respective plug opening when the connector is assembled;

a socket seal arranged about a seal channel on the plurality of sockets;

a plurality of cables connected to a first end of the plurality of sockets when the connector is assembled;

a cable seal arranged about at least a portion of each of a plurality of cables and adjacent to each socket;

a header housing having a plurality of header openings, each header opening being isolated from the other header openings, each header opening being mated with a respective plug opening when the header housing is connected to the plug housing;

a plurality of pins, each pin received by a corresponding socket when the connector is assembled;

the plug housing and sockets maintaining a sealed relationship when the plug housing is connected to and disconnected from the header housing; and the header housing and pins maintaining a sealed relationship when the header housing is connected to and disconnected from the plug housing.

* * * * *

UNITED STATES PATENT AND TRADEMARK OFFICE

CERTIFICATE OF CORRECTION

PATENT NO. : 7,419,397 B2
APPLICATION NO. : 11/598351
DATED : September 2, 2008
INVENTOR(S) : Paul G. Casperson It is certified that error appears in the above-identified patent and that said Letters Patent is hereby corrected as shown below:

Please correct the References Cited as follows:
Title Page, item (56), under "U.S. Patent Documents", in Column 2, Line 6, delete "5,231,357 A 7/1993 Moody et al." and insert -- 6,231,357 5-15-2001 Rumsey --.

Signed and Sealed this

Twenty-fourth Day of March, 2009

John Doll

JOHN DOLL
*Acting Director of the United States Patent and Trademark Office*